US005369478A

United States Patent [19]

Kobayashi et al.

[11] Patent Number: 5,369,478

[45] Date of Patent: Nov. 29, 1994

[54] DEVELOPING APPARATUS

[75] Inventors: Tetsuya Kobayashi, Kawasaki; Hiroshi Sasame, Yokohama; Tatsuya Kobayashi, Sohka; Naoki Enomoto; Akihiko Uchiyama, both of Yokohama; Yoshiro Saito, Kawasaki, all of Japan

[73] Assignee: Canon Kabushiki Kaisha, Tokyo, Japan

[21] Appl. No.: 171,707

[22] Filed: Dec. 22, 1993

[30] Foreign Application Priority Data

Dec. 25, 1992 [JP] Japan ..... 4-346708

[51] Int. Cl.[5] ..... G03G 15/06; G03G 15/08

[52] U.S. Cl. ..... 355/259; 355/245; 355/260

[58] Field of Search ..... 355/259, 245, 260, 253, 355/261; 118/661, 653; 430/120, 903

[56] References Cited

U.S. PATENT DOCUMENTS 5,032,852 7/1991 Fujii et al. ..... 346/157
5,170,213 12/1992 Yamaguchi et al. ..... 355/245 X
5,177,537 1/1993 Okano et al. ..... 355/259
5,183,964 2/1993 Stelter et al. ..... 118/653
5,202,729 4/1993 Miyamoto et al. ..... 355/251
5,307,127 4/1994 Kobayashi et al. ..... 355/259

*Primary Examiner*—Matthew S. Smith
*Attorney, Agent, or Firm*—Fitzpatrick, Cella, Harper & Scinto

[57] ABSTRACT

A developing apparatus includes a rotatable developer carrying member for carrying one component developer to a developing zone for developing an electrostatic latent image for an image bearing member; a regulating member for regulating a thickness of a layer of the developer to be carried by the developer carrying member to the developing zone; a rotatable developer, in contact with the developer carrying member, for supplying the developer; a developer guiding portion for guiding reverse movement of the developer blocked by the regulating member; wherein $0.02 \leqq d/Vs \leqq 0.1$ is satisfied, where d is a minimum distance between the developer guiding portion and the developer feeding member (mm), and Vs is a peripheral speed of the developer feeding member (mm)/sec.

9 Claims, 8 Drawing Sheets

DEVELOPING APPARATUS

FIELD OF THE INVENTION AND RELATED ART

The present invention relates to a developing apparatus for developing an electrostatic latent image with one component developer.

Referring first to FIG. 7, there is shown a conventional developing apparatus using one component developer, which will hereinafter be called "toner". Such a developing apparatus comprises an opening 102 facing an electrophotographic photosensitive drum 1, and behind it there is provided a developer container 20 for containing non-magnetic toner.

In the developer container 120, a developing sleeve 105 of electrically conductive material is disposed to carry the toner to the photosensitive drum 1. The developing sleeve 105 is disposed in the developer container 120 such that a part of the outer peripheral surface thereof is exposed to the outside through the opening 102. The developing sleeve 105 faces the photosensitive drum 1 with an minimum clearance (gap) of 50–500 μm to constitute a developing zone D where the toner is supplied from the developing sleeve 105 onto the photosensitive drum 1 so as to develop the electrostatic latent image. In the developer container 120, a supply roller 107 supplies toner to the developing sleeve 105 in conjunction with conveying means 106. The developing sleeve 105 is supplied with a developing bias voltage which is in the form of a DC biased AC voltage. The developing bias voltage is supplied from a bias voltage source 100. At a toner outlet of the developing chamber 103, there is disposed an elastic blade 108 for regulating a thickness of a layer of a toner to be carried on the developing sleeve 105 to the developing zone. An end of the blade 108 is fixed to the developer container 120 and is contacted to the sleeve 105 counter-directionally. In a toner inlet of the developing chamber 103, a leakage preventing sheet 110 is disposed to prevent leakage of the toner at the bottom portion of the developer container 120.

During a developing operation, the conveying means 106 feeds the toner to the feeding roller 107 rotating in the direction indicated by an arrow. In this manner, the toner is applied on the developing sleeve 105 by the feeding roller 107, The developing sleeve 105 is rotated in the direction indicated by an arrow in FIG. 7, and the toner carried on the developing sleeve 105 is formed into a layer of the toner having a thickness greater than the minimum gap between the sleeve and the drum, by the regulating blade 108, and is fed to the developing zone D, where an oscillating electric field is formed by the developing bias voltage, and the toner jumps to the portion of the electrostatic latent image on the photosensitive drum 1 by the force provided by the electric field.

The toner is triboelectrically charged by friction with the sleeve 105 when it is rubbed with the developing sleeve 105 by the feeding roller 107, but it is mainly charged triboelectrically by friction with the sleeve 105 at the nip between the blade 108 and the sleeve 105, and further by friction with the blade 108 to such an extent as to be capable of developing the electrostatic latent image. However, if the toner particles are not properly circulated in the developing chamber 103, a problem arises, as shown in FIG. 8, that is, the image density is low at an initial stage, and the image density increases with the image forming operation (transient density increasing phenomenon), If the toner circulation is not sufficient in the developer container, the toner stagnates in the neighborhood "A" of the end portion of the regulating blade, resulting in a overcharge-up of the toner, which will retard further triboelectric charging of the toner. If this occurs, both overcharged toner and undercharged toner are fed to the developing zone D. The overcharged toner is not easily separated from the sleeve by the mirror force, and on the contrary, the undercharged toner is not influenced very much by the electric field provided by the developing bias voltage, and therefore, they are not easily transferred onto the photosensitive drum. As a result, the density becomes sufficient.

During continuous image forming operations, the undercharged toner particles are gradually triboelectrically charged to a sufficient level, and therefore, the image density increases. Thus, a transient density change as shown in FIG. 8 occurs. The stagnation of the toner in the region "A" promotes deterioration of the toner if a continuous image forming operation is continued for a long period of time, resulting in production of a foggy background and reduction of the image density.

SUMMARY OF THE INVENTION

Accordingly, it is a principal object of the present invention to provide a developing apparatus in which density variation and foggy background production are suppressed.

It is another object of the present invention to provide a developing apparatus in which one component developer is properly circulated in a developer container.

It is a further object of the present invention to provide a developing apparatus in which d/Vs is limited in a predetermined range, where Vs is a peripheral speed of a feeding roller for feeding the toner to the developing sleeve, and d is a distance from a feeding roller to a toner guiding surface.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, description now will be made as to the embodiments of the present invention.

Figure 4:
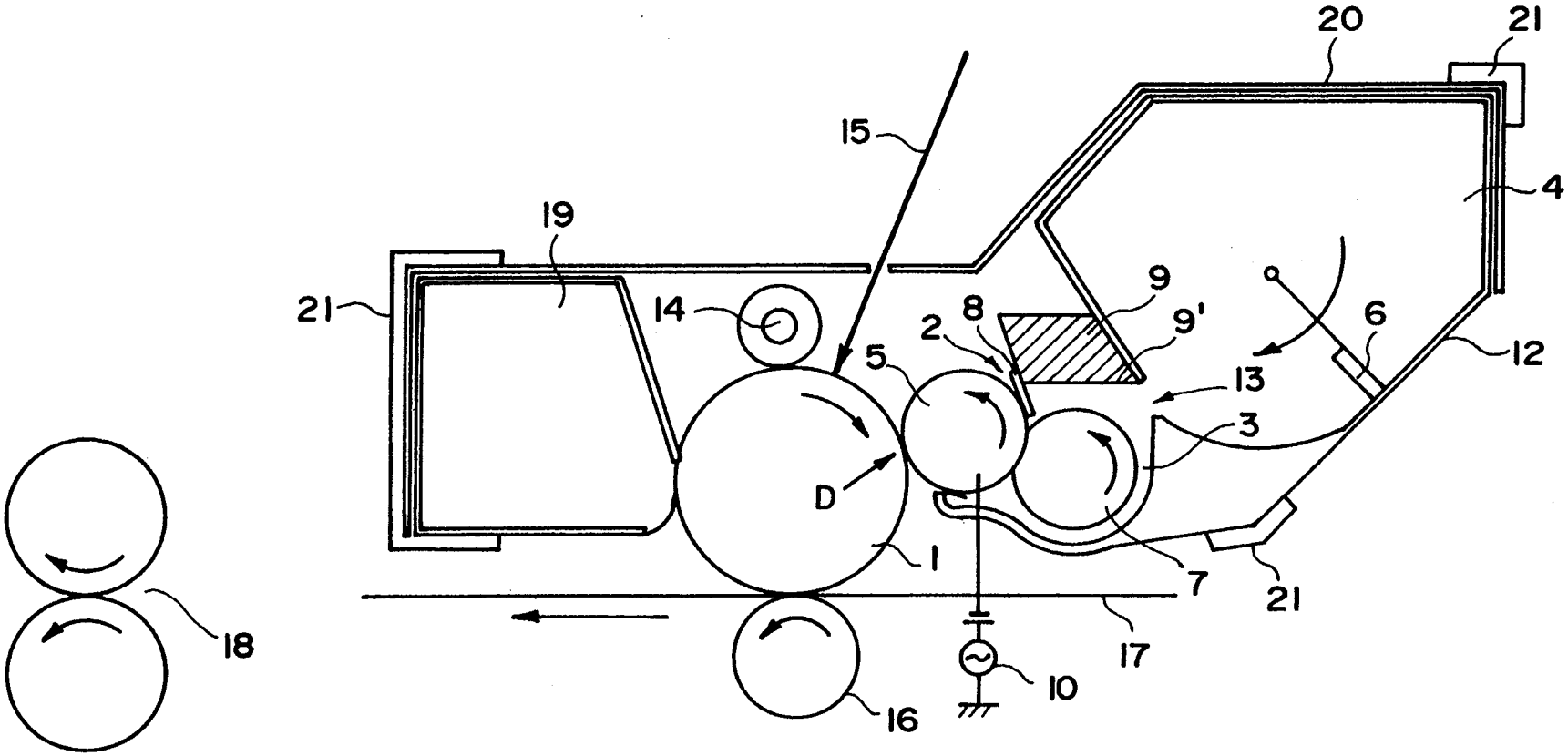
FIG. 4 is a sectional view of an electrophotographic apparatus according to an embodiment of the present invention.

Referring to FIG. 4, there is shown an electrophotographic apparatus using a developing apparatus according to an embodiment of the present invention.

In FIG. 4, a reference numeral 12 designates a developer container, which is provided with a second chamber 4 for containing non-magnetic one-component developer (non-magnetic toner), and a first chamber 3 in communication with the second chamber 4 through a slit opening 13 extending in a direction of a length of the developing sleeve 5 (perpendicular to the sheet of the drawing).

The toner in the second chamber 4 is supplied into the first chamber 3 through the slit opening 13 by rotating at a low speed in the direction indicated by an arrow a toner feeding member 6 in the form of a crank having an end to which an elastic sheet is bonded.

The first chamber 3 is provided with an opening 2, in which a developing sleeve 5 is disposed, which rotates in the direction indicated by an arrow. The peripheral surface of the sleeve 5 exposed to the outside of the first chamber 3 faces photosensitive drum 1 as an image bearing member. The sleeve 5 carries the toner supplied in the first chamber 3 to feed the toner to the drum 1 to the developing zone D where the electrostatic latent image on the drum 1 is developed. In the developing zone D, the minimum gap between the sleeve 5 and the drum 1 is 50–500 μm.

The developing sleeve 5 is composed of aluminum or stainless steel which may be coated with gold, carbon, platinum, ceramic material or the like to reduce the electric resistance. The coating material may be made integral therewith. The present invention is not limited to using a sleeve. Alternatively, a solid developing roller may be used.

The developing sleeve 5 is supplied with a developing bias voltage in the form of a DC biased AC voltage (having a DC voltage component and an AC voltage component) from a developing bias voltage source 10, by which an oscillating electric field is formed in the developing zone D.

In the first chamber 3, a feeding roller 7 feeds toner to the developing sleeve 5, that is, toner fed into the first chamber 3 by the toner feeding member 6 is provided in such a manner that it is in contact with the developing sleeve 5 at a portion where the developing sleeve 5 rotates in a upward direction. In order to assure the proper toner supply and application at this time, the feeding roller 7 may be made of a sponge material, may be knurled, or may be brushed, preferably.

The feeding roller 7, is rotated in the same rotational direction as the developing sleeve 5. In other words, at the nip formed between the sleeve 5 and the roller 7, the peripheral surfaces of the sleeve 5 and the roller 7 move in opposite directions.

The toner supplied to the upper surface portion of the feeding roller 7 through the slit opening 13, is moved substantially at the same speed as the peripheral speed of the feeding roller 7 by the rotation of the feeding roller 7, so that it is applied on the developing sleeve 5.

The roller 7 not only applies the toner to the developing sleeve 5, but also removes from the sleeve 5 a toner layer remaining on the developing sleeve 5 after passing through the developing zone D. Thus, the roller 7 functions to remove the remaining toner layer at the inlet side of the sleeve 5 at the nip between the sleeve 5 and the roller 7 and applies the toner to the sleeve 5 at the outlet side of the sleeve 5. An image hysteresis due to the development exists in the remaining toner layer on the sleeve, but removal of the remaining toner layer, effectively prevents production of a ghost in the developed image.

In the first chamber 3, there is provided a regulating blade 8 for regulating the layer of the thickness of the toner on the developing sleeve fed by the supplying roller. An end of the blade 8 is fixed to a toner guiding member 9 which will be described hereinafter. A convex side at the other end portion (free end portion) is elastically in contact with the developing sleeve 5 at a portion where the developing sleeve 5 rotates upwardly.

The free end of the blade 8 is disposed below a toner guiding surface 9′ of the guiding member 9. The blade 8 is in contact with the sleeve counter-directionally. In other words, the free end of the blade 8 is disposed upstream of a fixed end with respect to the rotational direction of the sleeve 5.

The blade 8 comprises a base plate including an elastic metal plate such as phosphor bronze thin sheet or stainless steel sheet or elastic PET thin sheet, and a rubber elastic material, having at least a portion in contact with the developing sleeve 5, of urethane rubber, silicone rubber or the like, preferably. However, a base plate without the rubber elastic material is usable, or it may be only the elastic material such as rubber without the base plate.

In any case, the described elastic blade 8 is effective to regulate the thickness of the toner layer to be carried to the developing zone D to be smaller than the minimum gap between the sleeve and the drum. In other words, a so-called non-contact development is carried out in this embodiment. In the developing zone D, the toner jumps to the photosensitive drum 1 by the oscillating electric field to be deposited on the electrostatic latent image.

However, the present invention is applicable to a so-called contact type development in which the thickness of the toner layer is larger than the minimum gap between the sleeve and the drum is formed on the sleeve so as to contact the developer layer to the drum.

The toner is triboelectrically charged by friction with the sleeve 5 when it is rubbed with the sleeve 5 by the feeding roller 7, but it is mainly charged to a sufficient extent for the development by friction with the sleeve 5 or further with the blade 8 when the developer passes through the nip formed between the sleeve 5 and the blade 8.

The image forming process now will be described. The photosensitive drum 1 rotates in the direction indicated by an arrow, and is uniformly charged by a charging roller 14. Thereafter, it is exposed to a light beam 15 modulated in accordance with image information by a light emitting element such as laser, LED or the like, so that an electrostatic latent image is formed on the photosensitive drum 1. The electrostatic latent image is developed or visualized by toner fed to the developing zone by the developing sleeve 5. The visualized toner image is transferred from the photosensitive drum 1 to a transfer material 17 by a transfer roller 16. Then, the toner image is fixed into a permanent image on the transfer material by a fixing device 18. The toner remaining on the photosensitive drum 1 after the transfer step, is removed by a cleaner 19.

In this embodiment, the developing device, the photosensitive drum 1, the cleaner 19, and the charging roller 14 are integrally contained in a frame 20 of a process cartridge. The process cartridge is detachably mountable relative to the main assembly of the electrophotographic apparatus along a guide 21 in the main assembly. Accordingly, when the toner in the developer container 12 is used up, the cartridge is removed from the main assembly along the guide 21, and a fresh cartridge is inserted along the guide 21 to replace it.

Figure 1:
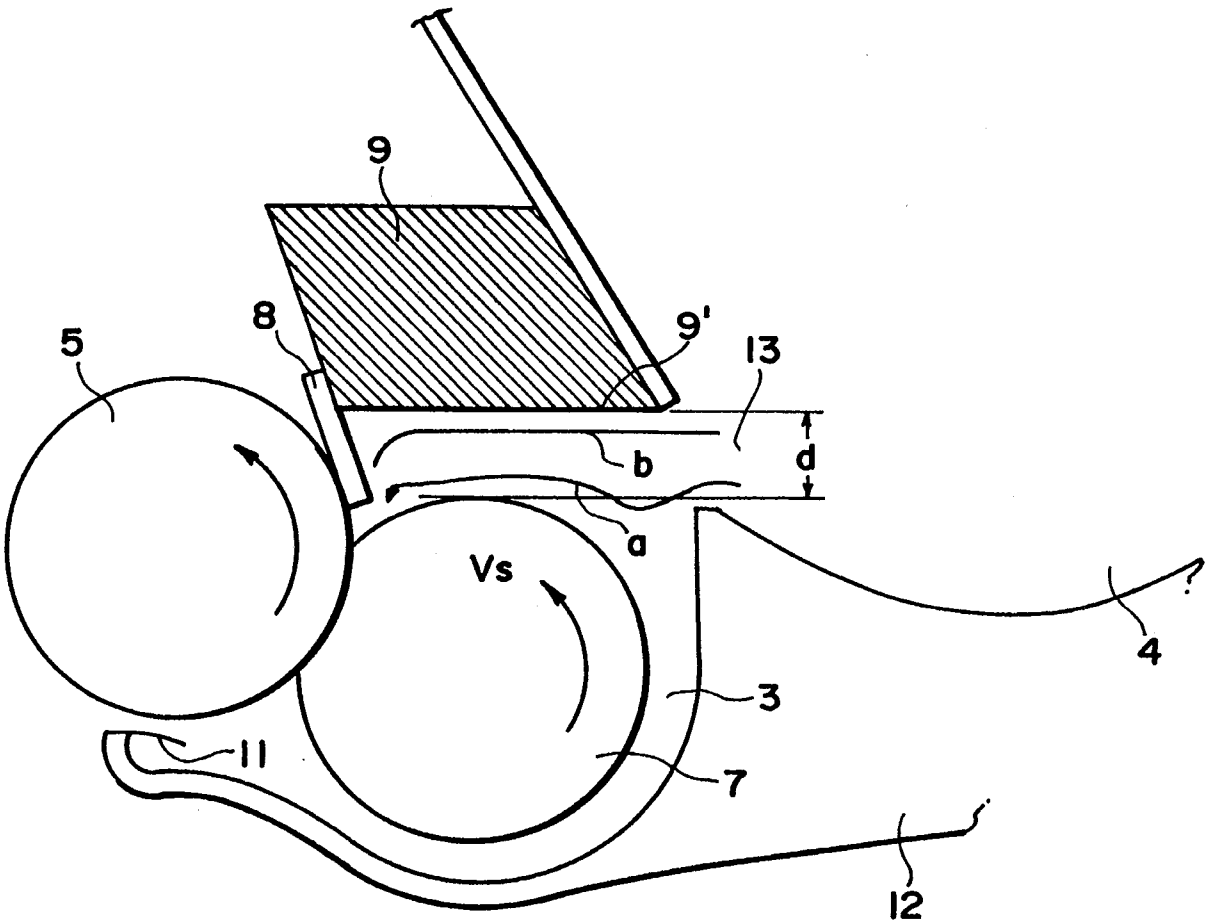
FIG. 1 is an enlarged view of an major part of a developing apparatus according to an embodiment of the present invention.

Referring to FIG. 1, the first chamber 3 is shown in a larger scale.

The toner guiding member 9 is provided with a toner guiding surface 9', above the end of the blade 8, for guiding, away from the blade, the toner blocked by the blade 8 from passing through the nip formed between the blade 8 and the sleeve 5 (that is, passage thereof toward the developing zone d is prevented).

The toner guiding surface 9' extends to an upper edge of the slit opening 13 from the blade 8.

The toner guiding surface 9' is preferably substantially parallel with the horizontal surface, or inclined relative to the horizontal surface thereof, so that it ascends away from the sleeve.

The toner supplied into the first chamber 3 through the bottom edge portion of the slit opening 13 from the second chamber 4 is subjected to a feeding force due to the rotation of the feeding roller 7 to move in the direction indicated by an arrow a in the first chamber 3.

The blocked toner moves in a direction b, that is, the reverse direction (opposite from the direction indicated by an arrow a). The guiding surface 9' guides such lateral motion of the toner in the direction from the blade 8 to the opening 13. While the toner is being guided by the guiding surface 9', it returns into the second chamber 4 from the neighborhood of the upper edge of the slit opening 13.

Detailed investigations have revealed that the motion of the toner in the first chamber 3 is ruled by rotation of the feeding roller 7, and that the toner moving speed adjacent the end of the blade 8 is substantially the same as the peripheral speed Vs of the feeding roller 7.

Here, if the toner stagnates adjacent the end portion of the blade 8, overcharged toner particles are produced, resulting in a raised image density and the production of a foggy background. Therefore, it is preferable that the toner blocked by the blade 8 adjacent the nip, is quickly returned to the second chamber 4 which is a toner container.

It has been found if the inventors that by the minimum gap between the guiding surface 9' and the feeding roller 7 peripheral surface (the smallest distance) d (mm) and the peripheral speed Vs (mm/sec) of the feeding roller 7 are selected so as to satisfy d/Vs is not less than 0.02 and not more than 0.1, then stagnation of the toner adjacent the end of the blade 8 is prevented, and the toner is guided by the guiding surface 9' to quickly return to the second chamber 4.

Figure 5:
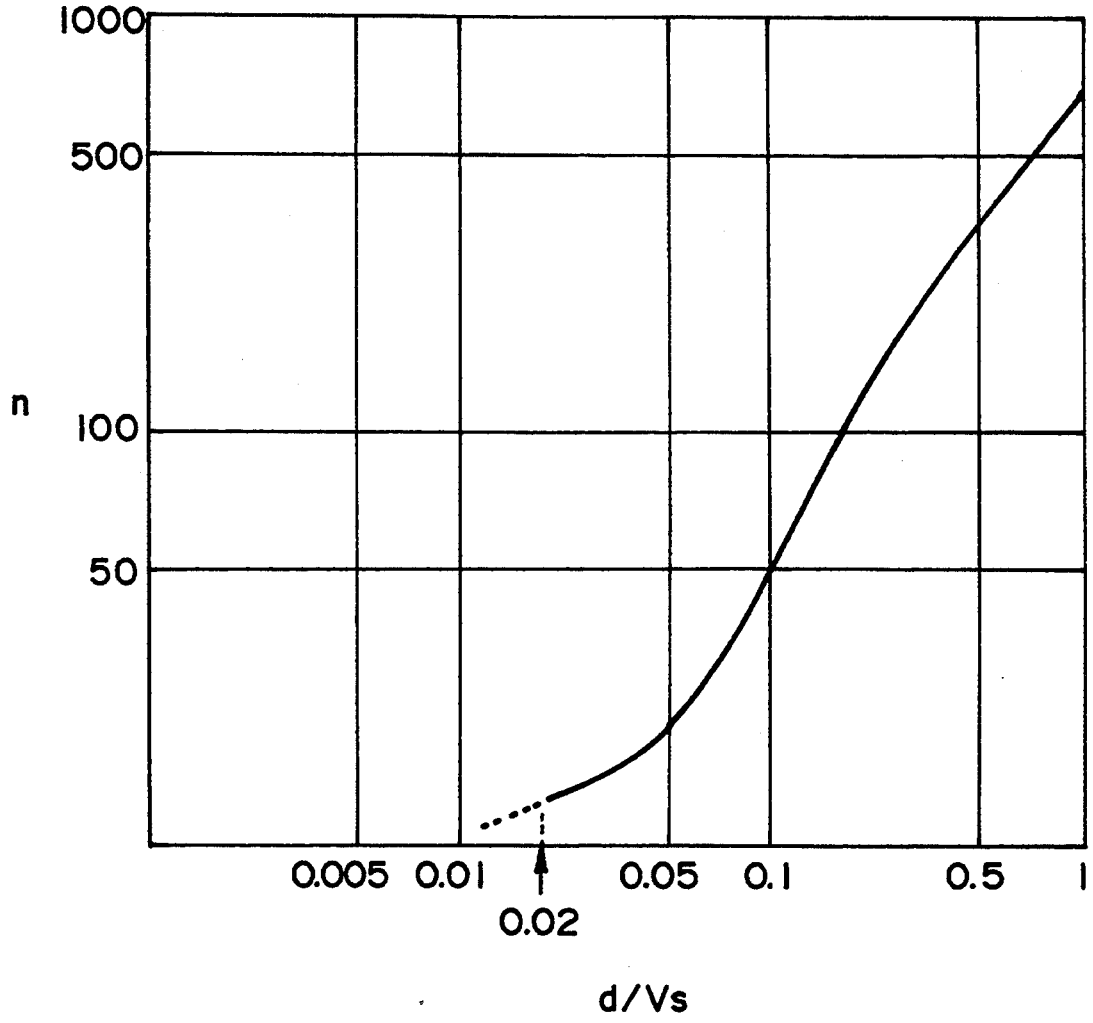
FIG. 5 illustrates a relationship between d/Vs and a number of prints required for the image density to saturate.

FIG. 5 shows a relationship between d/Vs and the number of prints n of A4 sheets from the initial density state to the saturated density state. Here, the saturated density is the optical reflection density of not less than 1.5 and a width of variation thereof is less than 0.05 .

As will be understood from FIG. 5, the density rising phenomenon is terminated within 50 sheets or less if d/Vs is not more than 0.1.

If d/Vs is larger than 0.1, the density increase is steep, and if d/Vs=1, the predetermined density is reached at 700 sheets. In this case, the toner is stagnated in the neighborhood of the end of the blade 8, or even if the toner is once reversed, is taken up by the toner motion in the direction a prior to returning to the second chamber 4 with the result that it circulates within the small region between the top portion of the roller 7 and the blade 8, and therefore, overcharging of the toner is not avoidable.

If d/Vs is not more than 0.02, the initial density is 1.48 on the print. However, the speed of the toner movement toward blade 8 is too high, and therefore, the toner does not sufficiently return to the toner container, and is pushed back by the rotation of the feeding roller 7. As a result, stagnation is brought about at the end portion of the blade 8, so that density reduction or another inconveniences have occurred.

Figure 6:
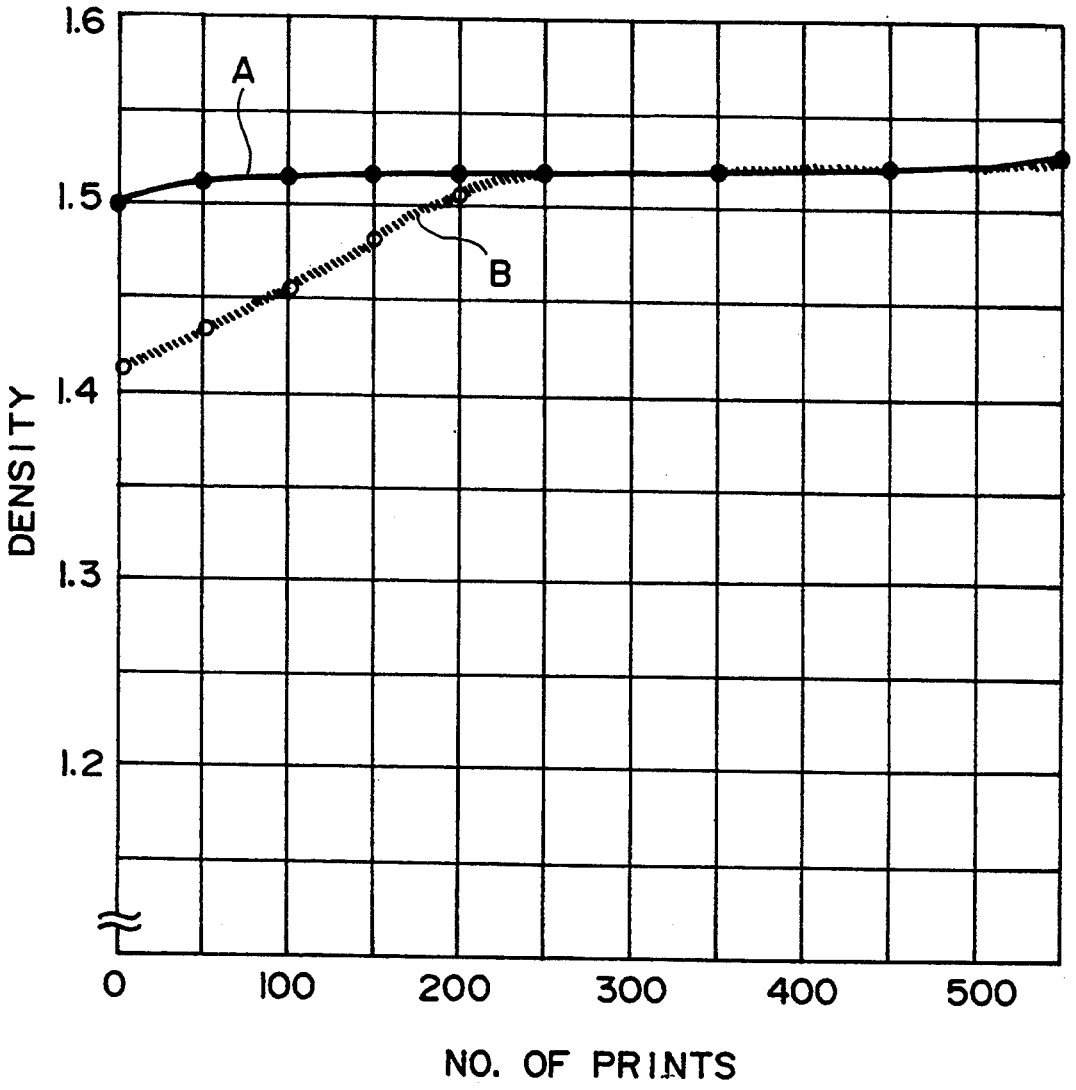
FIG. 6 illustrates a relationship between the number of prints and the image density.
Figure 7:
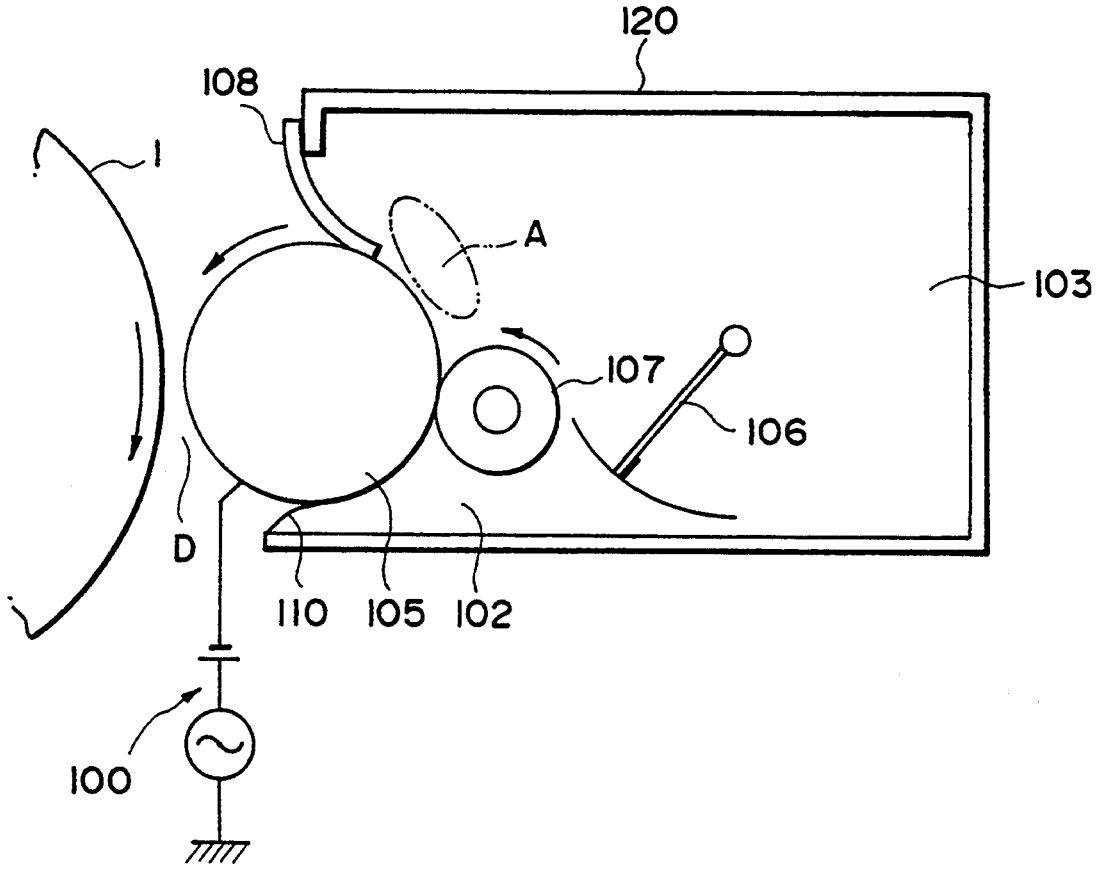
FIG. 7 PRIOR ART
FIG. 7 is a sectional view of a conventional developing apparatus.
Figure 8:
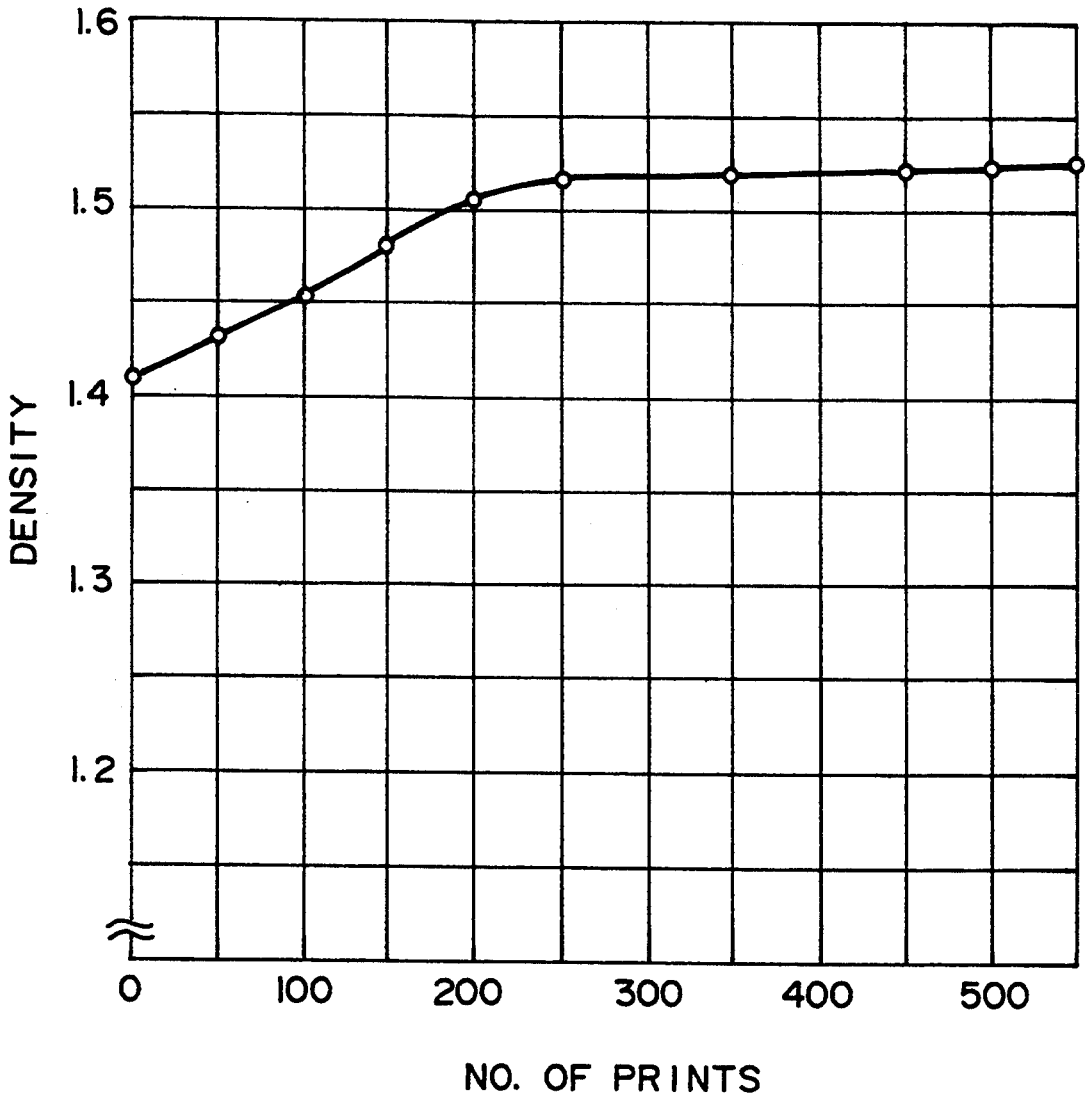
FIG. 8 illustrates a relationship between the number of prints and the image density.

FIG. 6 is a graph of the change of the image density and the number of prints when d/Vs is 0.1 and 0.5. In FIG. 6, line A represents d/Vs=0.1, and line B represents d/Vs=0.5 (conventional example). It will be understood that the density increasing problem has been avoided in this embodiment.

As described in the foregoing, in order to prevent overcharging or charging-up of the toner and to prevent the density increasing phenomenon, it is preferable that $0.02 \leqq d/Vs \leqq 0.1$ is satisfied. By doing so, satisfactory print images without foggy background with stable image density, can be provided.

Figure 2:
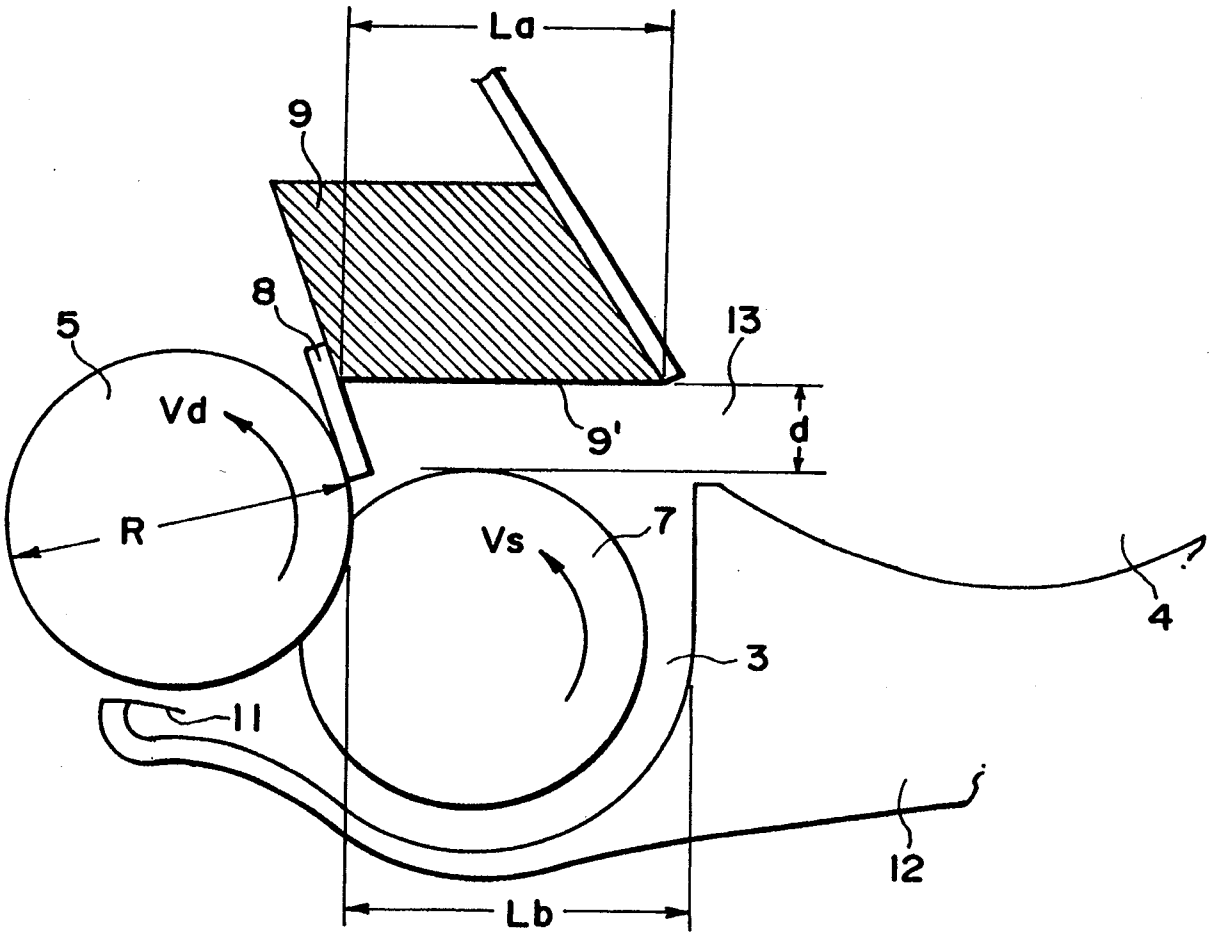
FIG. 2 is an enlarged view of a major part of a developing apparatus according to another embodiment of the present invention.

Referring to FIG. 2, another embodiment of the present invention will be described. Fundamentally, this embodiment is similar to the foregoing embodiment, and a description will be made as to the portions which are different from the first embodiment. According to this embodiment, a satisfactory solid image with uniformity, can be provided. In addition, this embodiment is suitable to high speed process operation for image formation.

In a manner similar to the foregoing embodiment, the toner supplied into the first chamber 3 is supplied onto the developing sleeve 5 by a feeding roller 7, and is regulated by the blade 8 to be formed into a uniform toner layer on the developing sleeve 5. On the other hand, the toner not included in the toner layer is returned into the second chamber 4 by way of a backside of the blade 8 and the toner guiding surface 9'. At this time, $0.02 \leqq d/Vs \leqq 0.1$ is satisfied, and therefore, the increasing image density problem can be avoided.

In order to prevent a phenomenon in which the developed image in the first rotation of the developing sleeve is dark and the second and subsequent images are thinner particularly when the image forming operation is carried out at high speed, it is preferable that the above-described condition of $0.02 \leqq d/Vs \leqq 0.1$ is satisfied and that the toner taken into the first chamber 3 is returned into the second chamber 4 while the developing sleeve 5 rotates through one rotation. This is accomplished by selecting the above-described "d" a width (mm) La of the toner guiding surface 9' in the guiding direction (the direction from the blade to the slit opening), Lb a distance (mm) in the horizontal direction between the contact portion between the toner supplying roller 7 and the developing sleeve 5 and the bottom edge of the slit opening 13, the above-described Vs, a diameter R (mm) of the developing sleeve 5, and a peripheral speed (mm/sec) Vd of the developing sleeve 5, so as to satisfy: $(d+La+Lb)/Vs<\pi R/Vd$. According to this embodiment, the toner in the space between the feeding roller 7 and the toner guiding surface 9' can be exchanged while the sleeve 5 rotates through one full-turn, and therefore, the proper development is possible by toner having a proper triboelectric charge.

As described, according to this embodiment, by satisfying the above relations, uniformity of the image density can be assured, and therefore, a solid image having sufficient density can be provided even if the image forming operation is performed at a high speed.

Figure 3:
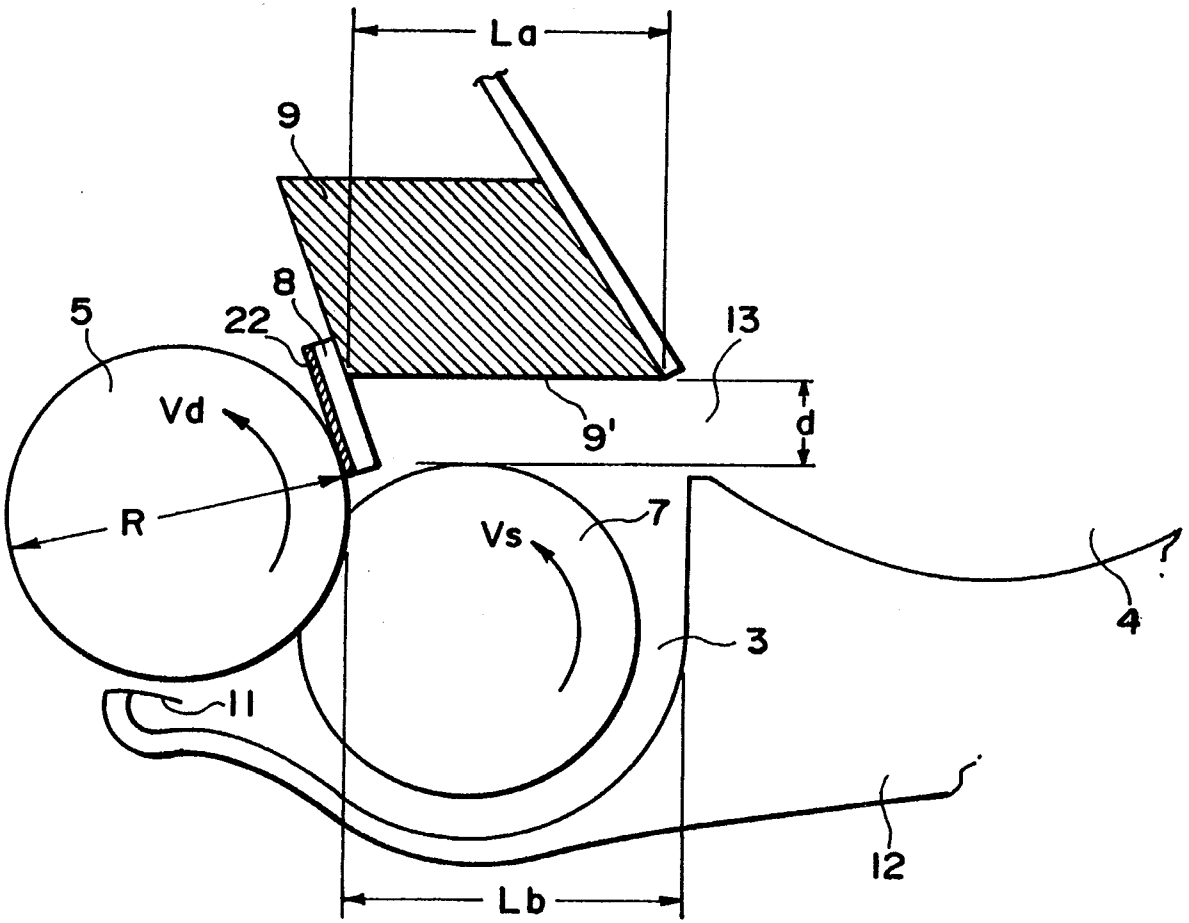
FIG. 3 is an enlarged view of a major part of a developing apparatus according to a further embodiment of the present invention.

Referring to FIG. 3, a further embodiment of the present invention will be described. Fundamentally, this embodiment is the same as in the first and second embodiment, and therefore, description will be made as to the points which are different from these embodiments.

In the embodiment of FIG. 3, the surface of the blade 8 in rubbing contact with the toner is coated with a material having a property of being triboelectrically charged to a polarity opposite from that of the toner. In this embodiment, a negatively chargeable toner is used, and the coating layer 22 comprising nylon, acrylic resin, cellophane, vinyl alcohol or the like having a positively chargeable property is dispersed in a solvent, and is applied thereto.

The coating layer 22 per se is charged to a polarity opposite from that of the toner, and therefore, it can strongly charge the toner triboelectrically. Therefore, it is most suitable in the case of a one component developing system in which sufficient triboelectric charge is desirably instantaneously applied in the nip between the blade 8 and the sleeve 5. By instantaneously raising of the toner triboelectric charging, the density increasing phenomenon can be substantially eliminated.

The density increasing phenomenon is influential to the change of the line width of the developed image. When a line image of 200 μm is formed with the developing device exhibiting the density rising phenomenon as indicated by line A in FIG. 6, the variation of the line width from an initial line width to a line width at the 50th sheet (completion of the rising period), is approx. 20 μm. This variation is not tolerable in a developing apparatus for fine image formation. Therefore, if the fine image is required, the density rising phenomenon is further decreased, preferably. Therefore, the toner stagnation in the first chamber is prevented, and the instantaneous triboelectric charge application is preferably accomplished. According to this embodiment, the provision of the coating layer 22 effectively prevents the density increasing phenomenon and suppresses the line width change.

According to this embodiment, it is possible to enhance the charge retention power of the toner easily influenced by ambient conditions by the provision of the coating layer 22, and therefore, the usable range is expanded. In this embodiment, the coating layer 22 is provided by applying a material, but a sheet of a positively chargeable material described in the foregoing alternatively may be bonded on the elastic material of the blade. The same advantageous effects have been confirmed.

When the toner has a positive charging property, the material of the coating layer 22 is of a negative charging property, such as PTFE, polyimide, PVdF, silicone resin or the like. This is applied on the elastic material of the blade, or a sheet made of such a material is bonded thereto. Alternatively, the silicone resin material may be rubber-formed and directly bonded onto a base plate. In this manner the same advantageous effects can be provided.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:
   a rotatable developer carrying member for carrying one component developer to a developing zone for developing an electrostatic latent image on an image bearing member;
   a regulating member for regulating a thickness of a layer of the developer to be carried by said developer carrying member to the developing zone;
   a rotatable developer supplying member, in contact with said developer carrying member, for supplying the developer thereto; and
   a developer guiding portion for guiding a reverse movement of developer blocked by said regulating member;
   wherein $0.02 \leqq d/Vs \leqq 0.1$ is satisfied,
   where d is a minimum distance between said developer guiding portion and said developer supplying member (mm), and Vs is a peripheral speed of said developer feeding supplying member (mm)/sec.

2. An apparatus according to claim 1, further comprises a first chamber containing said developer guiding portion and a second chamber for containing the developer in communication with said first chamber through an opening, and wherein said developer guiding member guides, toward said second chamber, the developer blocked by said regulating member.

3. An apparatus according to claim 2, wherein $(d+La+Lb)/Vs<\pi R/Vd$ is satisfied,
   where Vd is a peripheral speed of said developer carrying member (mm/sec), R is a diameter thereof (mm), La is a width of said developer guiding member in its guiding direction (mm), and Lb is a distance from a contact portion between said developer carrying member and said developer supplying member to said opening.

4. An apparatus according to any one of claims 1, 2 and 3, wherein said regulating member is in contact with said developer carrying member, and a surface of said regulating member contacted with said developer carrying member is of a material chargeable to a polarity opposite from that of the developer.

5. An apparatus according to claim 1, wherein said regulating member is contacted to said developer carrying member counterdirectionally.

6. An apparatus according to claim 5, wherein said developer guiding portion is disposed at an upper position of the regulating member rather than at an end of said regulating member which is in contact with the developer carrying member.

7. An apparatus according to claim 1, wherein said developer guiding portion and said developer supplying member are facing to each other.

8. An apparatus according to claim 1, wherein a layer thickness of the developer regulated by said regulating member is smaller than a minimum gap between the image bearing member and said developer carrying member.

9. An apparatus according to claim 1, wherein an oscillating bias voltage is applied to said developer carrying member.

* * * * *

UNITED STATES PATENT AND TRADEMARK OFFICE

CERTIFICATE OF CORRECTION

PATENT NO. : 5,369,478

DATED : November 29, 1994

INVENTOR(S) : TETSUYA KOBAYASHI, ET AL.

It is certified that error appears in the above-indentified patent and that said Letters Patent is hereby corrected as shown below:

COLUMN 2

Line 5, "a" should read --an--.

COLUMN 3

Line 55, "a" should read --the--; and "the" should read --a--.

COLUMN 5

Line 55, "if" should read --by--; and "by" should read --if--.

COLUMN 6

Line 48, "the" (first occurrence) should be deleted.

UNITED STATES PATENT AND TRADEMARK OFFICE

CERTIFICATE OF CORRECTION

PATENT NO. : 5,369,478

DATED : November 29, 1994

INVENTOR(S) : TETSUYA KOBAYASHI, ET AL.

It is certified that error appears in the above-indentified patent and that said Letters Patent is hereby corrected as shown below:

COLUMN 7

Line 43, "the" should read --a--.

COLUMN 8

Line 27, "feeding" should be deleted;
Line 29, "prises" should read --prising--.

Signed and Sealed this

Twenty-fifth Day of April, 1995

*Attest:*

*Attesting Officer*

BRUCE LEHMAN

*Commissioner of Patents and Trademarks*